US006364739B1

(12) United States Patent
Dutka et al.

(10) Patent No.: US 6,364,739 B1
(45) Date of Patent: Apr. 2, 2002

(54) NURSING REMINDER ACCESSORY AND BRASSIERE

(76) Inventors: Michael Dutka, P.O. Box 216, Mechanicsville, PA (US) 18934; Lois R. Fulton, P.O. Box 397, Charleston, RI (US) 02813

( * ) Notice: Subject to any disclaimer, the term of this patent is extended or adjusted under 35 U.S.C. 154(b) by 0 days.

(21) Appl. No.: 09/788,163

(22) Filed: Feb. 16, 2001

(51) Int. Cl.[7] ..... A41C 3/00
(52) U.S. Cl. ..... 450/37; 450/38; 450/36
(58) Field of Search ..... 450/36, 37, 54–57

(56) References Cited

U.S. PATENT DOCUMENTS 4,423,734 A * 1/1984 Schawel ..... 450/37
4,878,879 A * 11/1989 Kunstadter ..... 450/36
5,092,812 A * 3/1992 Babcock ..... 450/36

* cited by examiner

*Primary Examiner*—Gloria M. Hale
(74) *Attorney, Agent, or Firm*—Joseph P. Errico; Timothy J. Bortree

(57) ABSTRACT

An apparatus for assisting a two-breasted wearer of a nursing brassiere in determining which breast was most recently used for nursing or which breast should next be used for nursing. Some embodiments include a flexible element attached to the brassiere at a first end and coupled at a second end to either of two portions of the brassiere, with the coupled portion reminding the woman to use a particular breast. In other embodiments, attachment of the flexible element to a portion can restrict access to the non-preferred breast. In other embodiments, an indicator attached to the brassiere can be placed in at least two states, each indicating a preference for a particular breast. In other embodiments, an alternating release switch on the brassiere uses a toggle to automatically release a coupling element of a breast cup associated with a preferred breast.

10 Claims, 5 Drawing Sheets

NURSING REMINDER ACCESSORY AND BRASSIERE

FIELD OF THE INVENTION

The invention is directed to nursing accessories and more particularly to apparatuses for assisting a two-breasted wearer of a nursing brassiere in determining which breast was most recently used for nursing or which breast should next be used for nursing.

BACKGROUND OF THE INVENTION

Nursing mothers are typically advised by their physicians to alternate the use of their breasts from one nursing session to another. That is, the physician advises that if a mother's baby has nursed from, for example, her right breast during a nursing session, she should have the baby nurse from her left breast during the next nursing session. This pattern allows the milk supply in the most recently used breast to be replenished and allows the breast's nipple area to recuperate from the recent nursing activity.

Frequent nursing sessions and myriad activities between nursing sessions routinely cause many nursing mothers to forget which breast was most recently used for nursing, or which breast should next be used for nursing, according to the physician's recommendation. Therefore, there is a need for a nursing accessory that assists nursing mothers in remembering which breast is preferred for nursing for the next nursing session.

Even nursing mothers who have strong memories may occasionally be mistakenly sure that they have correctly remembered which breast is preferred for nursing, but may use the non-preferred breast anyway. Therefore, there is a need to restrict nursing mothers from using the non-preferred breast for the next nursing session.

Nursing brassieres are known in the art to provide full support for a nursing mother's breasts while offering temporary access to the nipple areas of the breasts for nursing sessions. That is, the nursing brassieres are configured to provide full support for both breasts while the mother is not nursing the baby, but allow the mother to, for example, access her right breast during a nursing session, while still providing full support for her left breast, and vice versa.

Unfortunately, while providing such functionality, none of the presently available nursing brassieres assist the mother in remembering which breast was most recently used for nursing, or which breast should next be used for nursing, according to the physician's recommendation. Therefore, there is a need for a nursing brassiere that assists a nursing mother in remembering which breast is preferred for nursing for the next nursing session.

In addition, mothers that use nursing brassieres may attempt to use the non-preferred breast for the next nursing session without realizing that the breast is not preferred. Therefore, there is a need to restrict nursing mothers who wear nursing brassieres from using the non-preferred breast for the next nursing session.

SUMMARY OF THE INVENTION

The invention addresses the shortcomings discussed above and other limitations of the prior art by providing an apparatus for assisting a two-breasted wearer of a nursing brassiere in determining which breast was most recently used for nursing or which breast should next be used for nursing.

In an embodiment, the apparatus includes a flexible element that has a first end attached to the brassiere and a second end that can be coupled to either a first portion of the brassiere or a second portion of the brassiere. The first portion is associated with one of the woman's breasts and the second portion is associated with the other breast.

In one aspect, the second end includes a sleeve that can be opened and closed about either portion. The first portion includes a first fastener that must be released before the first breast can be accessed for nursing. The second portion includes a second fastener that must be released before the second breast can be accessed for nursing. When the second end is coupled to the first fastener access to the first fastener for release is restricted. When the second end is coupled to the second fastener access to the second fastener for release is restricted. Preferably, the second end includes a sleeve that can be opened and closed about either fastener, such that when the sleeve is closed about the first fastener the first fastener cannot be accessed for release, and when the sleeve is closed about the second fastener the second fastener cannot be accessed for release.

In another embodiment, the first portion includes a first mating element integrated with the brassiere, the second portion includes a second mating element integrated with the brassiere, and the second end includes a coupling element that can be mated with either mating element.

In one aspect, the coupling element has a protrusion and each mating element has a recess for receiving the protrusion and biasing the protrusion therein. The brassiere includes a first fastener that must be released before the first breast can be accessed for nursing, and a second fastener that must be released before the second breast can be accessed for nursing. When the coupling element is mated with the first mating element access to the first fastener for release is restricted. When the coupling element is mated with the second mating element access to the second fastener for release is restricted. Preferably, the first portion is adjacent the first fastener and the second portion is adjacent the second fastener, such that when the coupling element is mated with the first mating element the first fastener is covered by the coupling element and when the coupling element is mated with the second mating element the second fastener is covered by the coupling element.

In yet another embodiment, the apparatus includes an indicator that can be placed in at least two states. A first state indicates a nursing preference for the first breast and a second state indicates a nursing preference for the second breast.

In one aspect, the indicator is attached to or integrated with the brassiere and the indicator can be rotated with respect to the brassiere to place the indicator in any of the states. In another aspect, when the indicator is in the first state, a portion of the indicator points toward the first breast, and when the indicator is in the second state, the portion of the indicator points toward the second breast. Preferably, the indicator is attached to or integrated with a central portion of the brassiere, the central portion includes a socket, and the indicator includes a protrusion that can rotate within the socket.

In still another embodiment, the apparatus includes a switch. The apparatus can be part of a nursing brassiere adapted to be worn on the upper body of a woman to support her breasts during normal wear periods and to provide access to either breast during nursing periods. The nursing brassiere comprises a pair of breast cups secured to the upper body of the woman so that each accommodates one of the breasts. At least a portion of the first breast cup must be moved before the first breast can be accessed for nursing. At least a portion of the second breast cup must be moved before the second breast can be accessed for nursing. An activation of the switch permits the portion of the first breast cup to be moved and prevents the portion of the second breast cup from being moved. A subsequent activation of the switch permits the portion of the second breast cup to be moved and prevents the portion of the first breast cup from being moved.

In one aspect, the apparatus includes an alternating release switch at a central portion of the brassiere; a first coupling element, on the portion of the first breast cup, that can be received by the switch; and a second coupling element, on the portion of the second breast cup, that can be received by the switch. When the first coupling element is received by the switch the first coupling element is secured in the switch and access to the first breast for nursing is restricted. When the second coupling element is received by the switch the second element is secured in the switch and access to the second breast for nursing is restricted. An activation of the switch when both of the coupling elements are secured in the switch releases only one of the coupling elements from the switch. After the switch releases the one coupling element from the switch, the switch is set to release only the other coupling element as a result of a subsequent activation of the switch.

DETAILED DESCRIPTION OF THE INVENTION

Figure 1:
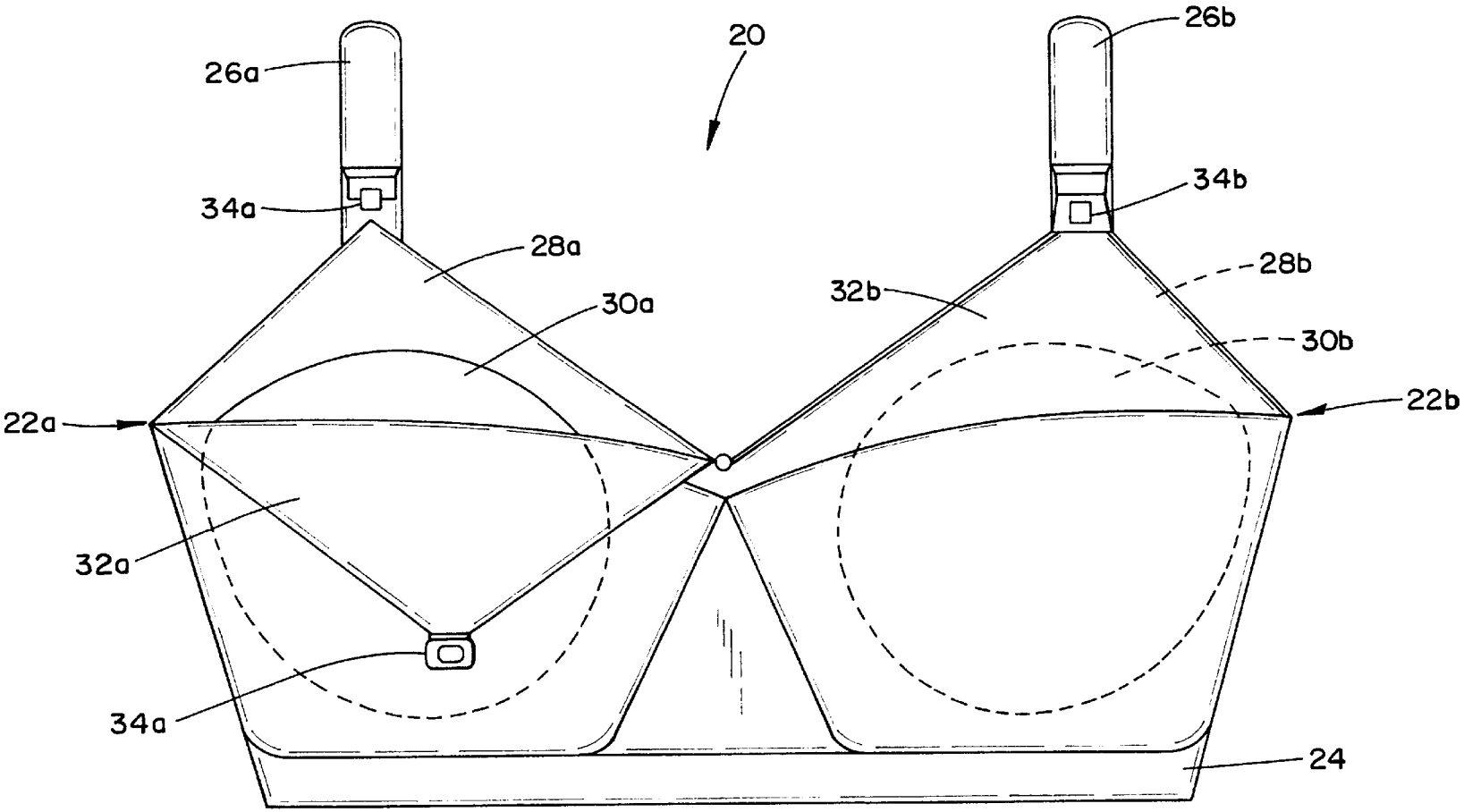
FIG. 1 illustrates a nursing brassiere.

FIG. 1 shows a nursing brassiere that will be discussed as one example of a brassiere that can be used with the invention. The brassiere is adapted to be worn on the upper body of a woman to support her breasts during normal wear periods and to provide access to either breast during nursing periods. The nursing brassiere 20 includes a pair of breast cups 22*a*, 22*b* connected to a band 24 and straps 26*a*, 26*b* so that the brassiere 20 can be secured to the upper body of a woman (not shown) such that each breast cup 22*a*, 22*b* accommodates one of her breasts. Each of the breast cups 22*a*, 22*b* has an inner support panel 28*a*, 28*b* that supports the breast while providing an opening 30*a*, 30*b* for access to the nipple area during a nursing period. Each of the breast cups 22*a*, 22*b* further includes an outer flap 32*a*, 32*b* that can cover the opening 30*a*, 30*b* or expose the opening 30*a*, 30*b* as needed. In order to use one of her breasts for nursing while wearing the brassiere 20, the woman must open one of the outer flaps 32*a*, 32*b* to expose one of the openings 30*a*, 30*b*. To hold the outer flaps 32*a*, 32*b* closed when the breasts are not being used, the brassiere 20 further includes fasteners 34*a*, 34*b*, one on each strap 26*a*, 26*b*. Each fastener 34*a*, 34*b* includes a latch on the strap 26*a*, 26*b* and a hook on the outer flap 32*a*, 32*b*. To open the outer flap 32*a*, 32*b*, the woman releases the hook from the latch and folds the outer flap 32*a*, 32*b* over. The "left" breast cup 22*b* is shown with the outer flap 32*b* closed. The "right" breast cup 22*a* is shown with the outer flap 32*a* open and folded over.

It should be understood that many types of brassieres exist, and that use of the invention is not limited to use with the illustrated brassiere. It will be clear from a reading of the following descriptions that the invention can be adapted for use with any brassiere, whether or not the brassiere is specifically manufactured for nursing. For example, some brassieres have more, fewer, or no straps; some brassieres have more, fewer, or no bands; some brassieres have additional panels or features; and some brassieres have different mechanisms for providing access to the breast for nursing. Some embodiments of the invention can be used regardless of the features and components of the brassiere. Of course, the embodiments of the invention that relate to preventing use of the mechanism for providing access to the breast for nursing necessarily require the brassiere to have such a mechanism.

Figure 2:
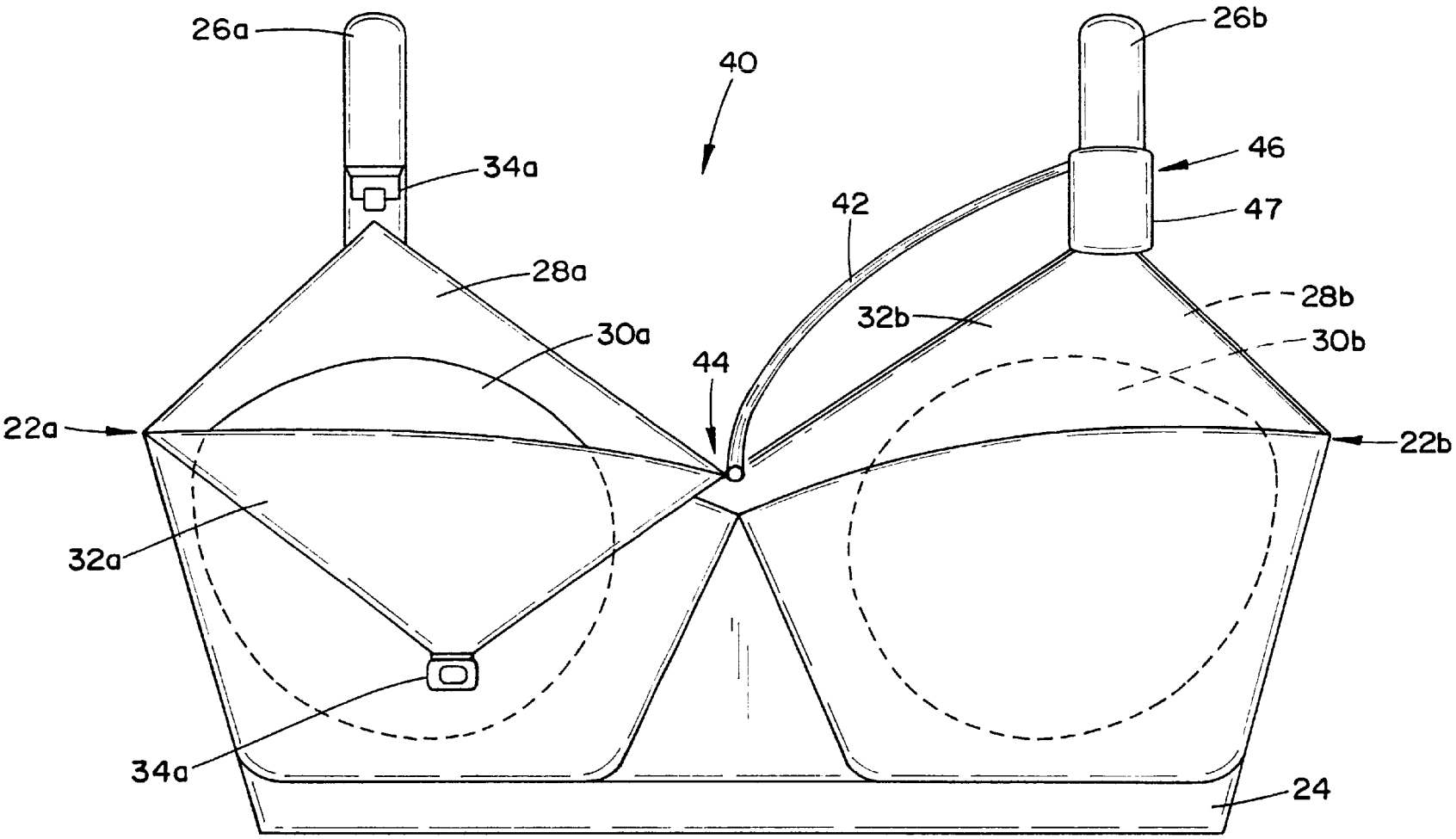
FIG. 2 illustrates a nursing brassiere similar to the brassiere of FIG. 1, but including an embodiment of the invention, having a flexible element with a sleeve.

In an embodiment, the invention is directed to an apparatus for assisting a two-breasted wearer of a nursing brassiere in determining which breast was most recently used for nursing or which breast should next be used for nursing. FIG. 2 illustrates this embodiment by presenting a brassiere 40. The brassiere 40 is similar to the brassiere 20 of FIG. 1, however, it further includes the apparatus. The apparatus includes a flexible element 42 shown as, for example, a ribbon 42. The ribbon 42 has a first end 44 that is attached the brassiere 40. The ribbon 42 also has a second end 46 that can be coupled to either a first portion 34*a* of the brassiere 40 or a second portion 34*b* of the brassiere 40. The flexibility of the ribbon 42 facilitates easy movement of the second end 46 from the first portion 34*a* to the second portion 34*b* and vice versa. The attachment of the first end 44 to the brassiere 40 prevents the second end 46 from being dropped or lost between transfers.

The first portion 34*a* is shown as, for example, a first fastener 34*a*. The second portion 34*b* is shown as, for example, a second fastener 34*b*. The first portion 34*a* is associated with one of the woman's breasts (referred to herein, for convenience, as her first breast or right breast) (not shown). While many types of associations between the first portion 34*a* and the first breast can be established, the association in this embodiment is defined inasmuch as the first fastener 34*a* must be released before the first breast can be accessed for nursing. Similarly, the second portion 34*b* is associated with the woman's other breast (referred to herein, for convenience, as her second breast or left breast) (not shown). While many types of associations between the second portion 34*b* and the second breast can be established, the association in this embodiment is defined inasmuch as the second fastener 34*b* must be released before the second breast can be accessed for nursing. Other associations can include the portion 34*a*, 34*b* being in proximity to the associated breast cup 22*a*, 22*b*, or being color- or design-coordinated or otherwise coordinated with the associated breast cup 22*a*, 22*b*. Other associations can include the portion 34*a*, 34*b* being on the brassiere 40 at a location that is labeled, designed or understood to reflect the desired association. Other associations may be established by the portion 34*a*, 34*b* being functional or configured in such a way that it can be used to reflect the desired association.

With regard to the coupling of the second end 46 to the first portion 34*a* or the second portion 34*b*, in this embodiment, the second end 46 of the ribbon 42 comprises a sleeve 47 that can be opened and closed about either portion 34*a*, 34*b*. To enable this functionality, the sleeve 47 includes, for example, a Velcro™ mechanism defined by a loop patch on one end of the sleeve 47 and a hook patch on the other end of the sleeve 47 so that when the ends are brought together they are secured thereby. A force applied to pull the ends apart releases the hooks from the loops and the ends can be separated. In this manner, the sleeve 47 can be opened and closed about the first fastener 34*a* or the second fastener 34*b*. This functionality not only serves to remind the woman which breast was most recently used for nursing or which breast should next be used for nursing, but also ensures that the woman will be restricted from using the most recently used breast for the next nursing session.

For example, the woman may use the first breast for nursing, and then close the sleeve 47 about the first fastener 34*a*. At the next nursing time, because the sleeve 47 is closed about the first fastener 34*a*, the association between the first fastener 34*a* and the first breast reminds the woman that the first breast was most recently used for nursing, or that the second breast should next be used for nursing. In addition, for example, because the closure of the sleeve 47 about the first fastener 34*a* restricts access to the first fastener 34*a* for release, and the first fastener 34*a* must be released before the first breast can be accessed for nursing, the woman cannot access the first breast for nursing until she opens the sleeve 47. This enhances the reminder and physically prevents the woman from using the first breast for nursing until she makes an active choice to open the sleeve 47. Preferably, closure of the sleeve 47 about the first fastener 34*a* prevents access to the first fastener 34*a* for release.

Similarly, for example, after the woman uses the second breast for nursing, she may close the sleeve 47 about the second fastener 34*b*. At the next nursing time, because the sleeve 47 is closed about the second fastener 34*b*, the association between the second fastener 34*b* and the second breast reminds the woman that the second breast was most recently used for nursing, or that the first breast should next be used for nursing. In addition, for example, because the closure of the sleeve 47 about the second fastener 34*b* restricts access to the second fastener for release, and the second fastener 34*b* must be released before the second breast can be accessed for nursing, the woman cannot access the second breast for nursing until she opens the sleeve 47. This enhances the reminder and physically prevents the woman from using the second breast for nursing until she makes an active choice to open the sleeve 47. Preferably, closure of the sleeve 47 about the second fastener 34*b* prevents access to the second fastener 34*b* for release.

Of course, if the woman so chooses, she can use the sleeve 47 for indications opposite those described above, such that closure about the first fastener 34*a* reminds her that the second breast was most recently used for nursing, or that the first breast should next be used for nursing, and that closure about the second fastener 34*b* reminds her that the first breast was most recently used for nursing, or that the second breast should next be used for nursing. However, the added function of restricting access to the fasteners for release is not present when the invention is so used.

Figure 3:
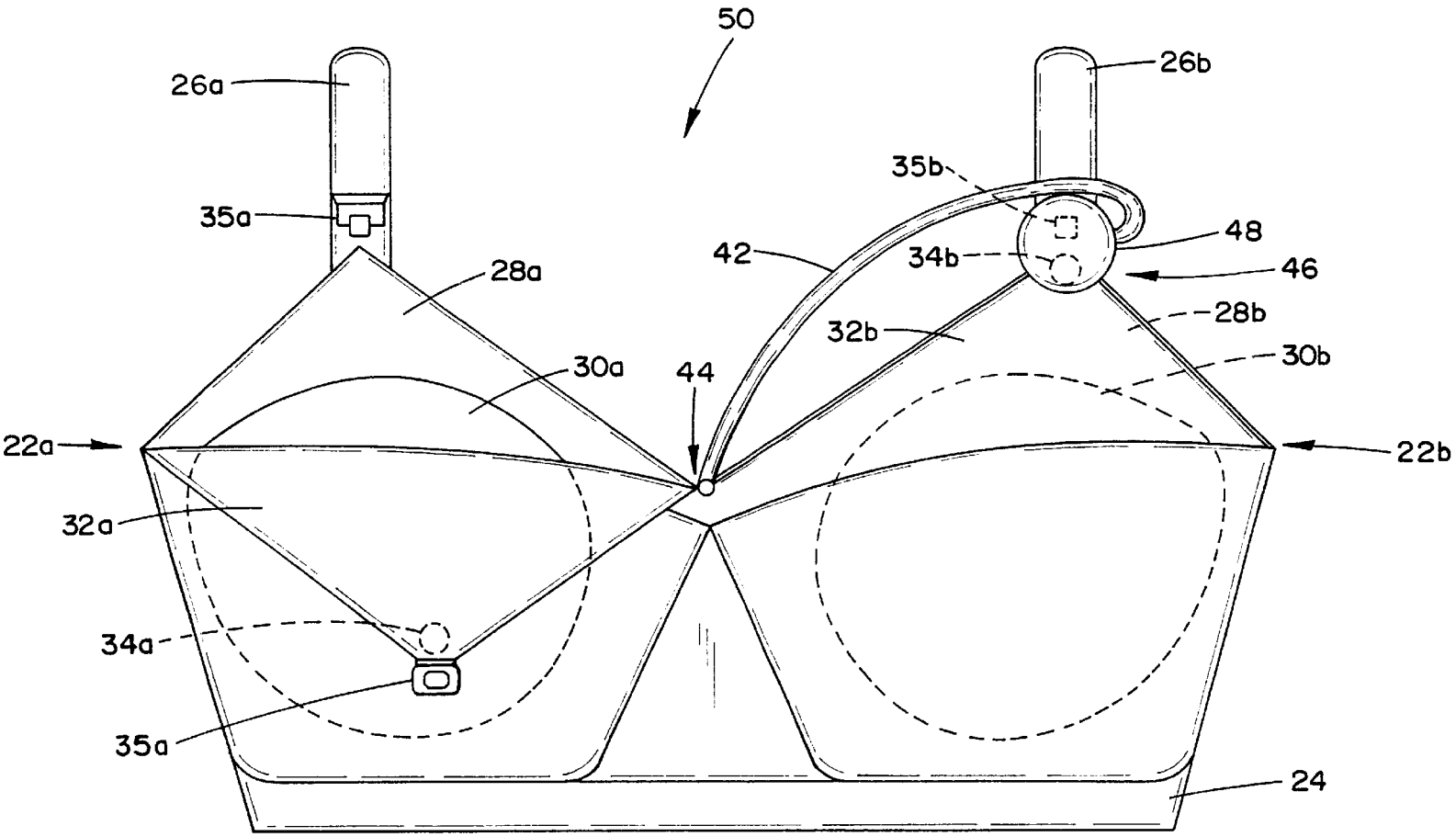
FIG. 3 illustrates a nursing brassiere similar to the brassiere of FIG. 1, but including another embodiment of the invention, having a flexible element with a medallion.

In another embodiment, the invention is again directed to an apparatus for assisting a two-breasted wearer of a nursing brassiere in determining which breast was most recently used for nursing or which breast should next be used for nursing. FIG. 3 illustrates this embodiment of the invention by presenting a brassiere 50. The brassiere 50 is similar to the brassiere 40 of FIG. 2, however, the first portion 34*a* of the brassiere 50 is not a first fastener, but rather is a first mating element 34*a* that is integrated with the brassiere 50. Similarly, the second portion 34*b* of the brassiere 50 is not a second fastener, but rather is a second mating element 34*b* that is integrated with the brassiere 50. Each mating element 34*a*, 34*b* shown here for example is a recessed portion 34*a*, 34*b* of a snap closure. The recessed portion 34*a*, 34*b* can be integrated with the brassiere 50 using, for example, an adhesive.

Another difference between the brassiere 40 of FIG. 2 and the brassiere 50 of FIG. 3 is that regarding the latter, the second end 46 of the ribbon 42, rather than having a sleeve 47, has a coupling element 48 that can be mated with either mating element 34*a*, 34*b*. The coupling element 48 shown here for example is a medallion that includes a protruding portion of a snap closure (hidden in FIG. 3). When the protruding portion is secured in either recessed portion 34*a*, 34*b*, it is biased therein. The protruding portion can be released from the recessed portion 34*a*, 34*b* when a force overcoming the bias is applied to pull the protruding portion from the recessed portion 34*a*, 34*b*. In this manner, the coupling element 48 can be mated to either the first mating element 34*a* or the second mating element 34*b*. The flexibility of the ribbon 42 makes it easy to move the coupling element 48 from the first mating element 34*a* to the second mating element 34*b* and vice versa. The attachment of the first end 44 to the brassiere 50 prevents the coupling element 48 from being dropped or lost between transfers.

The first portion 34*a* is associated with one of the woman's breasts (referred to herein, for convenience, as her first breast or right breast) (not shown). While many types of associations between the first portion 34*a* and the first breast can be established, the association in this embodiment is defined inasmuch as the first mating element 34*a* is integrated with the "right" breast cup 22*a* that accommodates the first breast. Similarly, the second portion 34*b* is associated with the woman's other breast (referred to herein, for convenience, as her second breast or left breast) (not shown). While many types of associations between the second portion 34*b* and the second breast can be established, the association in this embodiment is defined inasmuch as the second mating element 34*b* is integrated with the "left" breast cup 22*b* that accommodates the second breast. Other associations can include the portion 34*a*, 34*b* being in proximity to the associated breast cup 22*a*, 22*b*, or being color- or design-coordinated or otherwise coordinated with the associated breast cup 22*a*, 22*b*. Other associations can include the portion 34*a*, 34*b* being on the brassiere 50 at a location that is labeled, designed or understood to reflect the desired association. Other associations may be established by the portion 34*a*, 34*b* being functional or configured in such a way that it can be used to reflect the desired association.

The brassiere 50 also includes first and second fasteners 35*a*, 35*a*. Similar to the fasteners 34*a*, 34*b* of the brassiere 40 in FIG. 2, the first fastener 35*a* must be released before the first breast can be accessed for nursing, and the second fastener 35*b* must be released before the second breast can be accessed for nursing. The first mating element 34*a* is proximal to the first fastener 35*a* such that when the coupling element 48 is mated with the first mating element 34*a*, the medallion covers the first fastener 35*a*. Similarly, the second mating element 34*b* is proximal to the second fastener 35*b* such that when the coupling element 48 is mated with the second mating element 34*b*, the medallion covers the second fastener 34*b*. This functionality not only serves to remind the woman which breast was most recently used for nursing or which breast should next be used for nursing, but also ensures that the woman will be restricted from using the most recently used breast again for the next nursing session.

For example, the woman may use the first breast for nursing, and then mate the coupling element 48 with the first mating element 34*a*. At the next nursing time, because the coupling element 48 is mated with the first mating element 34*a*, the association between the first mating element 34*a* and the first breast reminds the woman that the first breast was most recently used for nursing, or that the second breast should next be used for nursing. In addition, for example, because the mating of the coupling element 48 with the first mating element 34*a* causes the medallion to cover the first fastener 35*a* and thereby restricts access to the first fastener 35*a* for release, and the first fastener 35*a* must be released before the first breast can be accessed for nursing, the woman cannot access the first breast for nursing until she removes the coupling element 48. This enhances the reminder and restricts the woman from accessing the first breast for nursing until she makes an active choice to remove the coupling element 48. Preferably, mating of the coupling element 48 with the first mating element 34*a* prevents access to the first fastener 35*a* for release.

Similarly, for example, after the woman uses the second breast for nursing, she may mate the coupling element 48 with the second mating element 34*b*. At the next nursing time, because the coupling element 48 is mated with the second mating element 34*b*, the association between the second mating element 34*b* and the second breast reminds the woman that the second breast was most recently used for nursing, or that the first breast should next be used for nursing. In addition, for example, because the mating of the coupling element 48 with the second mating element 34*b* causes the medallion to cover the second fastener 35*b* and thereby restricts access to the second fastener 35*b* for release, and the second fastener 35*b* must be released before the second breast can be accessed for nursing, the woman cannot access the second breast for nursing until she removes the coupling element 48. This enhances the reminder and physically restricts the woman from using the second breast for nursing until she makes an active choice to remove the coupling element 48. Preferably, mating of the coupling element 48 with the second mating element 34*b* prevents access to the second fastener 35*b* for release.

Of course, if the woman so chooses, she can use the coupling element 48 for indications opposite those described above, such that mating with the first mating element 34*a* reminds her that the second breast was most recently used for nursing, or that the first breast should next be used for nursing, and that mating with the second mating element 34*b* reminds her that the first breast was most recently used for nursing, or that the second breast should next be used for nursing. However, the added function of restricting access to the fasteners for release is not present when the invention is so used.

Figure 4:
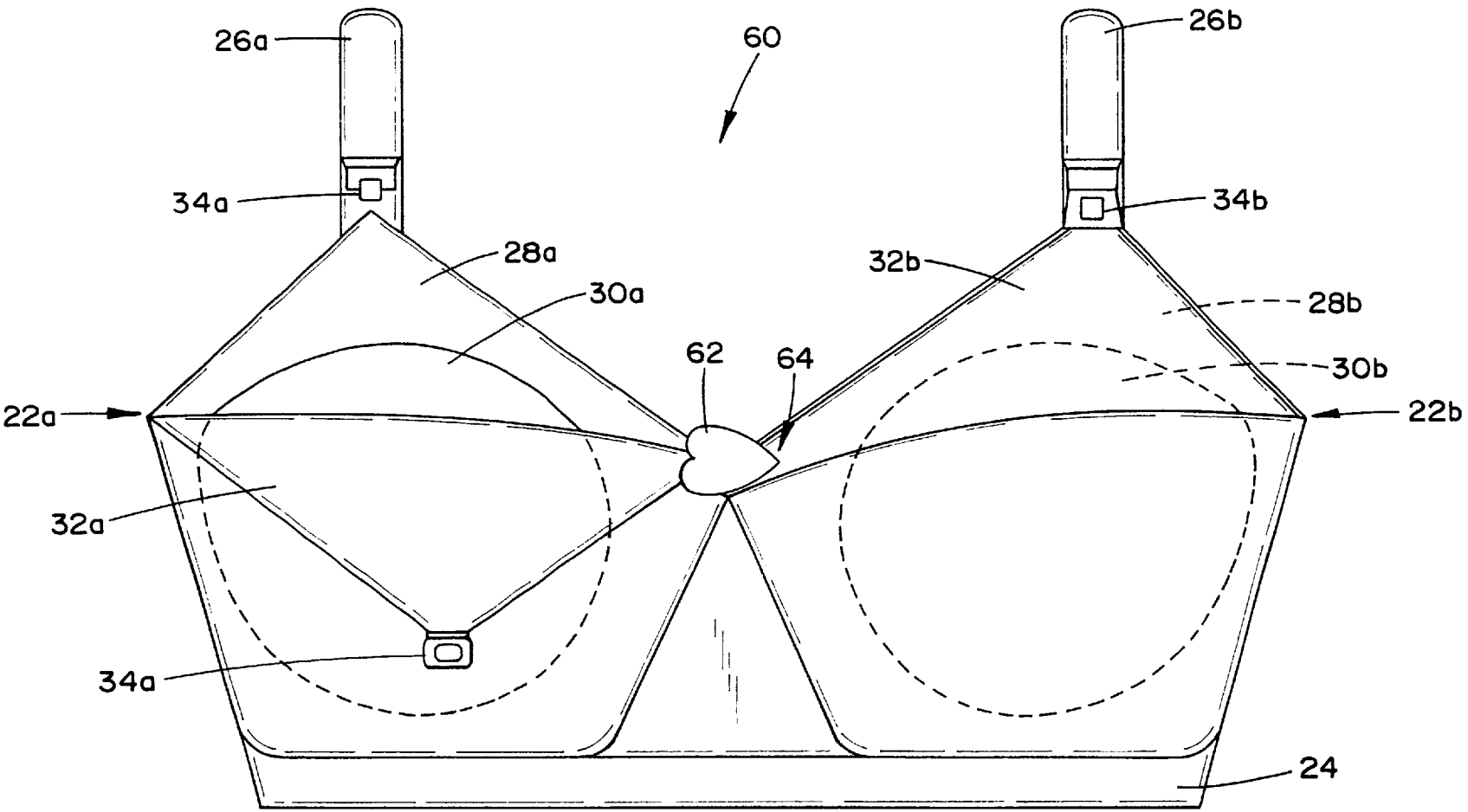
FIG. 4 illustrates a nursing brassiere similar to the brassiere of FIG. 1, but including yet another embodiment of the invention, having a heart-shaped indicator.

In yet another embodiment, the invention is again directed to an apparatus for assisting a two-breasted wearer of a nursing brassiere in determining which breast was most recently used for nursing or which breast should next be used for nursing. FIG. 4 illustrates this embodiment by presenting a brassiere 60 that is similar to the brassiere 20 of FIG. 1, but which includes the apparatus. The apparatus of the invention in this embodiment includes an indicator 62 that can be placed in at least two states. A first state indicates a nursing preference for one of the woman's breasts (referred to herein, for convenience, as her first breast or right breast) (not shown), and a second state indicates a nursing preference for the woman's other breast (referred to herein, for convenience, as her second breast or left breast) (not shown). The indicator 62 shown, for example, is a heart-shaped medallion 62 that includes a perimeter having a point 64. In order to prevent the woman from dropping or losing the indicator 62, the indicator 62 can be attached to or integrated with the brassiere 60. In this embodiment, the indicator 62 is attached to the brassiere 60. It should be noted that the indicator 62 need not be attached to the brassiere 60, and depending on the type of indicator 62 used, attachment to the brassiere 60 may or may not be required.

While many mechanisms can be used to place the indicator 62 in any of the states, depending on the type of indicator 62 used, the indicator 62 in this embodiment is attached to the brassiere 60 in such a way that it can be rotated with respect to the brassiere 60. This can be accomplished, for example, in that the portion of the brassiere 60 where the indicator 62 is attached includes a socket (hidden in FIG. 4), and the indicator 62 includes a protrusion (hidden in FIG. 4) that can rotate within the socket once it is secured in the socket. Rotation of the indicator 62 places the indicator 62 in any of the states.

Depending on the type of indicator 62 used and the construction of the brassiere 60, many types of states can be used to assist the woman in determining which breast was most recently used for nursing or which breast should next be used for nursing. Colors, designs, configurations, shapes, locations, labels, numerals, letters, symbols, lights or other indicating mechanisms can be used, and the invention is not limited for use with a specific type of indicator or indicator state. However, any indicator or indicator state used must be able to convey to the user of the apparatus which breast was most recently used for nursing or which breast should next be used for nursing. The ability of the indicator or indicator state to convey the information can be created or supplemented by inherent indications to the user, obvious indications to the user, instructions to the user, or suggestions to the user, or may simply be based on the understanding of the user according to indication rules established by the user or another party.

In this embodiment, the indicator 62 is attached to a central portion of the brassiere 60 and rotation of the indicator 62 directs the point 64 of the medallion 62 in the direction of one of the woman's breasts. Therefore, for example, when the indicator 62 is in the first state, the point 64 points toward the first breast, and when the indicator 62 is in the second state, the point 64 points toward the second breast. This functionality serves to remind the woman which breast was most recently used for nursing or which breast should next be used for nursing.

For example, the woman may use the first breast for nursing, and then rotate the indicator 62 so that the point 64 points toward the first breast. At the next nursing session, because the point 64 points toward the first breast, the woman is reminded that the first breast was most recently used for nursing, or that the second breast should next be used for nursing. Similarly, for example, after the woman uses the second breast for nursing, she may rotate the indicator 62 so that the point 64 points toward the second breast. At the next nursing session, because the point 64 points toward the second breast, the woman is reminded that the second breast was most recently used for nursing, or that the first breast should next be used for nursing.

Of course, if the woman so chooses, she can use the indicator 62 for other indication states, such as directing the point 64 upward to indicate that the first breast was most recently used for nursing, or that the second breast should next be used for nursing, and directing the point 64 downward to indicate that the second breast was most recently used for nursing, or that the first breast should next be used for nursing.

Figure 5:
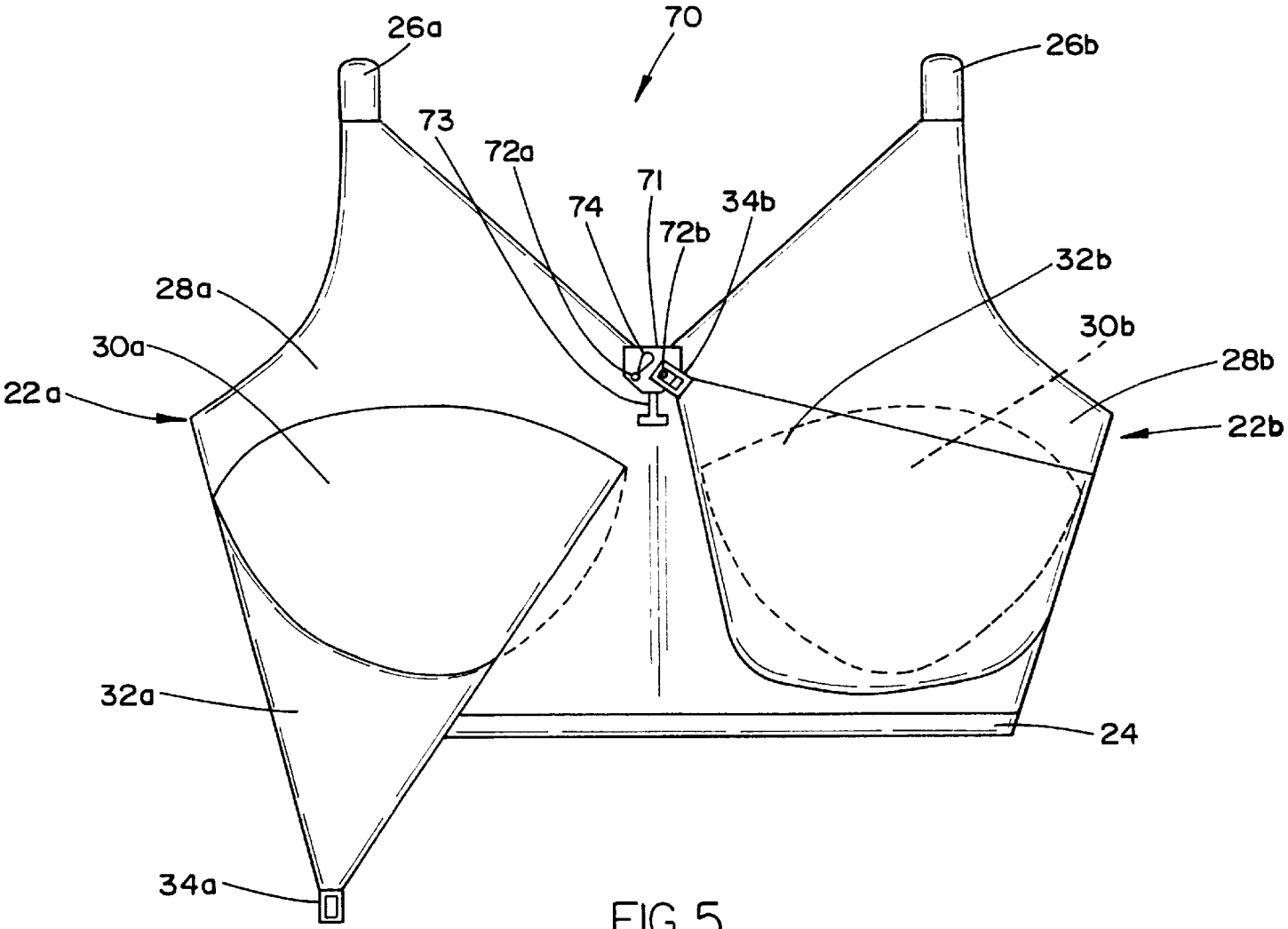
FIG. 5 illustrates a nursing brassiere similar to the brassiere of FIG. 1, but including yet another embodiment of the invention, having an alternating release switch.

In still another embodiment, the invention is again directed to an apparatus for assisting a two-breasted wearer of a nursing brassiere in determining which breast was most recently used for nursing or which breast should next be used for nursing. FIG. 5 illustrates this embodiment by presenting a brassiere 70 that is similar to the brassiere 20 of FIG. 1, but which includes the apparatus. Before one of the woman's breasts (referred to herein, for convenience, as her first breast or right breast) (not shown) can be accessed for nursing, at least a portion 32*a* of the first breast cup 22*a* must be moved. Similarly, before the other of the woman's breasts (referred to herein, for convenience, as her second breast or right breast) (not shown) can be accessed for nursing, at least a portion 32*b* of the second breast cup 22*b* must be moved before. The apparatus of the invention in this embodiment includes a switch 71. An activation of the switch 71 permits the portion 32*a* of the first breast cup 22*a* to be moved and prevents the portion 32*b* of the second breast cup 22*b* from being moved. A subsequent activation of the switch 71 permits the portion 32*b* of the second breast cup 22*b* to be moved and prevents the portion 32*a* of the first breast cup 22*a* from being moved.

Depending on the type of switch 71 used and the construction of the brassiere 70, many switch mechanisms can be used to achieve the described functionality to assist the woman in determining which breast was most recently used for nursing or which breast should next be used for nursing. The invention is not limited to the specific switch described below, and can encompass both mechanical and electrical switches, and even electromechanical switches.

In this embodiment, the switch 71 includes an alternating release switch 71 at a central portion of the brassiere 70; a first coupling element 34*a*, on the portion 32*a* of the first breast cup 22*a*, that can be received by the switch 71; and a second coupling element 34*b*, on the portion 32*b* of the second breast cup 22*b*, that can be received by the switch 71. The first coupling element 34*a* is illustrated here, for example, as a plastic loop 34*a*. The second coupling element 34*b* is illustrated here, for example, also as a plastic loop 34*b*. When the first coupling element 34*a* is received by the switch 71, the first coupling element 34*a* is secured in the switch 71 and access to the first breast for nursing is restricted. When the second coupling element 34*b* is received by the switch 71 the second element is secured in the switch 71 and access to the second breast for nursing is restricted. The securing of the coupling elements 34*a*, 34*b* in the switch 71 can be accomplished by the use of, for example, spring-loaded elements 72*a*, 72*b* in the switch 71 that pass through the loops 34*a*, 34*b*.

An activation of the switch 71 when both of the coupling elements 34*a*, 34*b* are secured in the switch 71 releases only one of the coupling elements 34*a*, 34*b* from the switch 71. After the switch 71 releases the one coupling element from the switch 71, the switch 71 is set to release only the other coupling element as a result of a subsequent activation of the switch 71.

The setting of the switch 71 can take place as a result of, for example, the subsequent receipt of the one coupling element (the one that was released) by the switch 71. This subsequent receipt sets the switch 71 to release only the other coupling element as a result of the subsequent activation of the switch 71. In this regard, the switch 71 can include a first mating element 72*a* for alternately securing and releasing the first coupling element 34*a*; a second mating element 72*b* for alternately securing and releasing the second coupling element 34*b*; and a toggle 74 that alternates between a first state and a second state. In the first state, the toggle 74 prevents the first mating element 72*a* from releasing the first coupling element 34*a* when the switch 71 is activated, and primes the second mating element 72*b* to release the second coupling element 34*b* when the switch 71 is activated. In the second state, the toggle 74 prevents the second mating element 72*b* from releasing the second coupling element 34*b* when the switch 71 is activated, and primes the first mating element 72*a* to release the first coupling element 34*a* when the switch 71 is activated. Further in this regard, the switch 71 can also include a switch button 73 that when activated causes, according to the toggle 74, a primed mating element (72*a* or 72*b*, whichever is primed by the toggle 74 at that moment) to release its associated coupling element. Subsequent receipt of the released coupling element by its associated mating element alternates the toggle.

For example, the woman may desire to enter into a nursing session, and fail to remember which breast was most recently used for nursing. Because the toggle 74 has previously been placed in one of the states (e.g., the second state), the toggle has primed the mating element (e.g., 72*a*) associated with the preferred breast (e.g., the first breast), to release the coupling element (e.g., 34*a*) associated with the preferred breast, the woman can simply activate the switch button 73 to cause the mating element 72*a* to release its associated coupling element 34*a* to expose the first breast for nursing. In this manner, the preferred breast is presented without the need for the woman to have remembered which breast is preferred. After the nursing session, the woman returns the coupling element 34*a* to the mating element 72*a*. This action alternates the toggle 74 to the first state, so that when the woman enters the next nursing session, she can simply activate the switch button 73 to cause the mating element 72*b* to release its associated coupling element 34*b* to expose the second breast for nursing. Again, the preferred breast is presented without the need for the woman to have remembered which breast is preferred.

The setting of the switch 71 can alternatively take place as a result of, for example, the activation of the switch 71. More specifically, the setting of the switch 71 takes place immediately after the respective coupling element is released by the mating element. In this regard, the switch 71 can include all of the elements 72*a*, 72*b*, 34*a*, 34*b* and 73 described above. However, the toggle 74 is alternated when the switch button 73 is activated, rather than the subsequent receipt of the released coupling element by its associated mating element.

For example, the woman may desire to enter into a nursing session, and fail to remember which breast was most recently used for nursing. Because the toggle 74 has previously been placed in one of the states (e.g., the second state), the toggle has primed the mating element (e.g., 72*a*) associated with the preferred breast (e.g., the first breast), to release the coupling element (e.g., 34*a*) associated with the preferred breast, the woman can simply activate the switch button 73 to cause the mating element 72*a* to release its associated coupling element 34*a* to expose the first breast for nursing. In this manner, the preferred breast is presented without the need for the woman to have remembered which breast is preferred. Here, the activation of the switch button 73 also alternates the toggle 74 to the first state. After the nursing session, the woman returns the coupling element 34*a* to the mating element 72*a*. Because the toggle 74 has already been set, when the woman enters the next nursing session, she can simply activate the switch button 73 to cause the mating element 72*b* to release its associated coupling element 34*b* to expose the second breast for nursing.

While the invention has been described and illustrated with reference to specific embodiments, it will be apparent to those skilled in the art that variations and modifications are possible without deviating from the broad spirit and scope of the invention that shall be limited solely by the scope of the claims appended hereto.

What is claimed is:

1. An apparatus for assisting a two-breasted wearer of a nursing brassiere in determining which breast was most recently used for nursing or which breast should next be used for nursing, the apparatus comprising:

a) a flexible element that has a first end attached to the brassiere and a second end that is coupleable to either a first portion of the brassiere or a second portion of the brassiere; wherein b) the first portion is associated with the first breast, and c) the second portion is associated with the second breast; and wherein d) the first portion comprises a first fastener that must be released before the first breast is accessible for nursing, e) the second portion comprises a second fastener that must be released before the second breast is accessible for nursing, f) when the second end is coupled to the first fastener access to the first fastener for release is restricted, and g) when the second end is coupled to the second fastener access to the second fastener for release is restricted.

2. The apparatus of claim 1, wherein:

a) the second end comprises a sleeve that is openable and closeable about either fastener;

b) when the sleeve is closed about the first fastener the first fastener is inaccessible for release; and c) when the sleeve is closed about the second fastener the second fastener is inaccessible for release.

3. An apparatus for assisting a two-breasted wearer of a nursing brassiere in determining which breast was most recently used for nursing or which breast should next be used for nursing, the apparatus comprising:

a) a flexible element that has a first end attached to the brassiere and a second end that is coupleable to either a first portion of the brassiere or a second portion of the brassiere; wherein b) the first portion is associated with the first breast, and c) the second portion is associated with the second breast; and wherein d) the first portion comprises a first mating element integrated with the brassiere, e) the second portion comprises a second mating element integrated with the brassiere, and f) the second end comprises a coupling element that is mateable with either mating element; and wherein g) the brassiere comprises a first fastener that must be released before the first breast is accessible for nursing, h) the brassiere comprises a second fastener that must be released before the second breast is accessible for nursing, i) when the coupling element is mated with the first mating element access to the first fastener for release is restricted; and j) when the coupling element is mated with the second mating element access to the second fastener for release is restricted.

4. The apparatus of claim 3, wherein:

a) the first portion is adjacent the first fastener;

b) the second portion is adjacent the second fastener;

c) when the coupling element is mated with the first mating element the first fastener is covered by the coupling element; and d) when the coupling element is mated with the second mating element the second fastener is covered by the coupling element.

5. A nursing brassiere adapted to be worn on the upper body of a woman to support her breasts during normal wear periods and to provide access to either breast during nursing periods, the brassiere comprising:

a) a pair of breast cups secured to the upper body of the woman so that each accommodates one of the breasts, and b) an apparatus that assists the woman in determining which breast was most recently used for nursing or which breast should next be used for nursing; wherein:

c) at least a portion of the first breast cup must be moved before the first breast is accessible for nursing, and d) at least a portion of the second breast cup must be moved before the second breast is accessible for nursing; and wherein e) the apparatus comprises a switch, f) an activation of the switch permits the portion of the first breast cup to be moved and prevents the portion of the second breast cup from being moved, and g) a subsequent activation of the switch permits the portion of the second breast cup to be moved and prevents the portion of the first breast cup from being moved.

6. A nursing brassiere adapted to be worn on the upper body of a woman to support her breasts during normal wear periods and to provide access to either breast during nursing periods, the brassiere comprising:

a) a pair of breast cups secured to the upper body of the woman so that each accommodates one of the breasts, and b) an apparatus that assists the woman in determining which breast was most recently used for nursing or which breast should next be used for nursing; wherein c) at least a portion of the first breast cup must be moved before the first breast is accessible for nursing, and d) at least a portion of the second breast cup must be moved before the second breast is accessible for nursing; and wherein the apparatus comprises e) an alternating release switch at a central portion of the brassiere, f) a first coupling element, on the portion of the first breast cup, that is receiveable by the switch, g) a second coupling element, on the portion of the second breast cup, that is receiveable by the switch; wherein h) when the first coupling element is received by the switch the first coupling element is secured in the switch and access to the first breast for nursing is restricted, i) when the second coupling element is received by the switch the second element is secured in the switch and access to the second breast for nursing is restricted, j) an activation of the switch when both of the coupling elements are secured in the switch releases only one of the coupling elements from the switch, and k) after the switch releases the one coupling element from the switch, the switch is set to release only the other coupling element as a result of a subsequent activation of the switch.

7. The brassiere of claim 6, wherein:

a) the activation of the switch when both of the coupling elements are received in the switch releases only the one coupling element from the switch; and b) a subsequent receipt of the one coupling element by the switch sets the switch to release only the other coupling element as a result of the subsequent activation of the switch.

8. The brassiere of claim 7, wherein the alternating release switch comprises:

a) a first mating element for alternately securing and releasing the first coupling element;

b) a second mating element for alternately securing and releasing the second coupling element;

c) a toggle that alternates between a first state and a second state:

i) in the first state, the toggle prevents the first mating element from releasing the first coupling element when the switch is activated, and primes the second mating element to release the second coupling element when the switch is activated;

ii) in the second state, the toggle prevents the second mating element from releasing the second coupling element when the switch is activated, and primes the first mating element to release the first coupling element when the switch is activated;

d) a switch button that when activated causes, according to the toggle, a primed mating element to release its associated coupling element; wherein e) subsequent receipt of the released coupling element by its associated mating element alternates the toggle.

9. The brassiere of claim 6, wherein the activation of the switch when both of the coupling elements are received in the switch releases only the one coupling element from the switch and sets the switch to release only the other coupling element as a result of the subsequent activation of the switch.

10. The brassiere of claim 9, wherein the alternating release switch comprises:

a) a first mating element for alternately securing and releasing the first coupling element;

b) a second mating element for alternately securing and releasing the second coupling element;

c) a toggle that alternates between a first state and a second state:

i) in the first state, the toggle prevents the first mating element from releasing the first coupling element when the switch is activated, and primes the second mating element to release the second coupling element when the switch is activated;

ii) in the second state, the toggle prevents the second mating element from releasing the second coupling element when the switch is activated, and primes the first mating element to release the first coupling element when the switch is activated;

d) a switch button that when activated causes, according to the toggle, a primed mating element to release its associated coupling element; wherein e) activation of the switch button alternates the toggle.

* * * * *